US009303348B2

(12) United States Patent
Kim et al.

(10) Patent No.: US 9,303,348 B2
(45) Date of Patent: Apr. 5, 2016

(54) WASHING MACHINE HAVING BUOYANCY CLUTCH

(71) Applicant: SAMSUNG ELECTRONICS CO., LTD., Suwon-si, Gyeonggi-do (KR)

(72) Inventors: Sang Wook Kim, Suwon-si (KR); Myung Hee Ryu, Suwon-si (KR); Sang Up Lee, Yongin-si (KR); Hong Seok Ko, Yongin-si (KR); Sang Yeon Pyo, Suwon-si (KR); Sung Jin Kim, Seongnam-si (KR); Young Hyun Kim, Suwon-si (KR); Seung Youp Lee, Yongin-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 52 days.

(21) Appl. No.: 13/953,256

(22) Filed: Jul. 29, 2013

(65) Prior Publication Data

US 2013/0312462 A1 Nov. 28, 2013

Related U.S. Application Data

(63) Continuation-in-part of application No. 13/863,776, filed on Apr. 16, 2013, now abandoned.

(30) Foreign Application Priority Data

Apr. 18, 2012 (KR) ..... 10-2012-0040314
Apr. 18, 2013 (KR) ..... 10-2013-0043182

(51) Int. Cl.
*D06F 21/08* (2006.01)

(52) U.S. Cl.
CPC ..... *D06F 21/08* (2013.01)

(58) Field of Classification Search
CPC ..... D06F 37/00; D06F 37/04; D06F 37/20; D06F 37/22; D06F 37/30; D06F 37/40; D06F 37/206; D06F 39/083; D06F 2058/2877; D06F 21/00; D06F 29/00; D06F 35/007; D06F 21/08; D06F 21/06; D06F 23/00; D06F 23/02; D06F 23/025; D06F 23/01; D06F 23/06; D06F 23/065
USPC ..... 68/12.24, 23.1, 23.7, 133, 139; 8/158, 8/159
See application file for complete search history.

(56) References Cited

U.S. PATENT DOCUMENTS 5,353,613 A * 10/1994 Smith et al. ..... 68/23.7
5,651,277 A * 7/1997 Richardson ..... 68/23.7

(Continued)

OTHER PUBLICATIONS

U.S. Appl. No. 13/863,776, filed Apr. 16, 2013, Myung Hee Ryu et al., Samsung Electronics Co., Ltd.

(Continued)

*Primary Examiner* — Michael Barr
*Assistant Examiner* — Rita Adhlakha
(74) *Attorney, Agent, or Firm* — Staas & Halsey LLP

(57) ABSTRACT

A washing machine including a tub, a spin basket rotatably mounted in the tub, a pulsator rotatably mounted in the spin basket and having a pulsator hub part extending downward from a center portion of the pulsator, a driving device to generate rotational force, a wash shaft to transmit the rotational force generated from the driving device to the pulsator, and a buoyancy clutch upwardly and downwardly movably mounted to the pulsator hub part and configured to move up and down by buoyancy. The buoyancy clutch is configured to rotate together with the pulsator. When the buoyancy clutch moves down, the spin basket is engaged with the buoyancy clutch and receives the rotational force.

21 Claims, 14 Drawing Sheets

(56) References Cited

U.S. PATENT DOCUMENTS

| | | | | |
|---|---|---|---|---|
| 6,634,193 | B2 * | 10/2003 | Lee et al. | 68/23.6 |
| 6,880,192 | B2 | 4/2005 | Lee et al. | |
| 7,443,074 | B2 | 10/2008 | Kim et al. | |
| 2007/0130999 | A1 * | 6/2007 | Dominguez et al. | 68/12.24 |
| 2013/0276483 | A1 * | 10/2013 | Ryu et al. | 68/12.24 |
| 2013/0312462 | A1 | 11/2013 | Kim et al. | |

OTHER PUBLICATIONS

U.S. Office Action issued Sep. 22, 2014 in copending U.S. Appl. No. 13/863,762.
U.S. Office Action issued Feb. 3, 2015 in copending U.S. Appl. No. 13/863,762.
U.S. Office Action issued Aug. 10, 2015 in copending U.S. Appl. No. 13/863,762.

* cited by examiner

WASHING MACHINE HAVING BUOYANCY CLUTCH

CROSS-REFERENCE TO RELATED APPLICATIONS

This application is a continuation-in-part and claims priority to U.S. application Ser. No. 13/863,762, filed on Apr. 16, 2013, and claims the benefit of Korean Patent Application Nos. 10-2012-0040314 and 10-2013-0043182, filed on Apr. 18, 2012 and Apr. 18, 2013, respectively, in the Korean Intellectual Property Office, the disclosures of which are incorporated herein by reference.

BACKGROUND

1. Field

Embodiments of the present disclosure relate to a washing machine having a buoyancy clutch capable of moving up and down according to a water level in a tub.

2. Description of the Related Art

A washing machine is an appliance that washes laundry using electric power. In general, a washing machine includes a tub to store wash water, a spin basket rotatably mounted in the tub, a pulsator rotatably mounted on a bottom of the spin basket, a driving device to rotate the spin basket and the pulsator, and a clutch to selectively transmit rotational force to the spin basket according to operation mode, i.e., the washing process or dehydration process.

In the washing process, rotational force generated from the driving device is selectively transmitted only to the pulsator and the pulsator rotates to generate water current in the spin basket, thereby achieving washing of laundry. In the dehydration process, rotational force generated from the driving device is transmitted to both the pulsator and the spin basket, and thus the pulsator and the spin basket rotate together, thereby achieving dehydration.

So as to accomplish transmission of rotational force from the driving device to only the pulsator in the washing process or to both the pulsator and the spin basket in the dehydration process, the washing machine includes a clutch to selectively transmit rotational force to the spin basket according to the washing or dehydration process.

SUMMARY

It is an aspect of the present disclosure to provide a washing machine equipped with a buoyancy clutch having a simpler structure and capable of stably transmitting rotational force to a spin basket.

Additional aspects of the disclosure will be set forth in part in the description which follows and, in part, will be apparent from the description, or may be learned by practice of the disclosure.

In accordance with one aspect of the present disclosure, a washing machine includes a tub, a spin basket rotatably mounted in the tub, a pulsator rotatably mounted in the spin basket and having a pulsator hub part extending downward from a center portion of the pulsator, a driving device to generate rotational force, a wash shaft to transmit the rotational force generated from the driving device to the pulsator, and a buoyancy clutch upwardly and downwardly movably mounted to the pulsator hub part and configured to move up and down by buoyancy. The buoyancy clutch is configured to rotate together with the pulsator, and when the buoyancy clutch moves down, the spin basket is engaged with the buoyancy clutch and receives the rotational force.

The pulsator may include at least one guide rail formed longitudinally in a vertical direction at an outer surface of the pulsator hub part, and the buoyancy clutch may include a guide hole in which the pulsator hub part is inserted and at least one guide protrusion protruding from an inner surface of the guide hole and upwardly and downwardly movably engaged with the at least one guide rail.

The at least one guide rail may include plural guide rails which are spaced apart from each other in a circumferential direction at an outer circumferential surface of the pulsator hub part, and the at least one guide protrusion may include plural guide protrusions which are spaced apart from each other in a circumferential direction at an inner circumferential surface of the guide hole. Each of the plural guide protrusions may be upwardly and downwardly movably engaged with each of the plural guide rails.

The buoyancy clutch may include at least one coupling recess formed at a bottom surface thereof, and the spin basket may include at least one coupling protrusion which is configured to be fitted into the at least one coupling recess when the buoyancy clutch moves down.

The spin basket may include a driving flange mounted to a bottom thereof, and the coupling protrusion may be formed integrally with the driving flange.

The spin basket may include a driving flange mounted to a bottom thereof and a coupling unit provided with the coupling protrusion and fixed to the driving flange.

The at least one coupling recess may include plural coupling recesses which are spaced apart from each other in a circumferential direction at a bottom surface of the buoyancy clutch, and the at least one coupling protrusion may include plural coupling protrusions which are spaced apart from each other in a circumferential direction at the spin basket.

The plural coupling recesses may be twice in number as the plural coupling protrusions.

Each of the plural coupling protrusions may be formed to have a gradually decreasing width toward a top end thereof.

The pulsator may include a receiving part which is opened downward to receive the buoyancy clutch therein. The pulsator hub part may protrude inside the receiving part. The receiving part may include plural recesses, each of which is defined by a bottom surface of each of washing ribs of the pulsator. The buoyancy clutch may include plural protruding parts provided at positions corresponding to the plural recesses of the receiving part.

The pulsator may include a barrier extending downward from a region near the pulsator hub part to surround a periphery of the pulsator hub part.

The barrier may be formed in a hollow cylindrical shape.

The barrier may extend to an extent that a lower end thereof is located at a lower position than a lower end of the guide rail.

The buoyancy clutch may include a clutch hub part formed with the guide hole and a barrier accommodating recess formed at a region near the clutch hub part to accommodate the barrier.

The buoyancy clutch may include a communication hole to communicate the barrier accommodating recess with a region below the buoyancy clutch.

In accordance with another aspect of the present disclosure, a washing machine includes a tub, a spin basket rotatably mounted in the tub, a pulsator rotatably mounted in the spin basket, a driving device to generate rotational force and transmit the rotational force to the pulsator, and a buoyancy clutch upwardly and downwardly movably mounted to the pulsator and configured to selectively transmit the rotational force to the spin basket by moving up or down by buoyancy. The pulsator includes plural washing ribs to generate water current and plural recesses, each of which is defined by a bottom surface of each of the plural washing ribs. The buoyancy clutch includes plural protruding parts provided at positions corresponding to the plural washing ribs and configured to be inserted into the plural recesses when the buoyancy clutch moves upward.

As described above, by virtue of the buoyancy clutch capable of moving up and down according to a water level in the tub, selective rotational force transmission to the spin basket is achieved stably and securely.

In addition, since the buoyancy clutch is provided with the protruding parts corresponding to the recesses defined by bottom surfaces of the washing ribs of the pulsator, a volume of the buoyancy clutch may be maximized within the limited mounting space.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
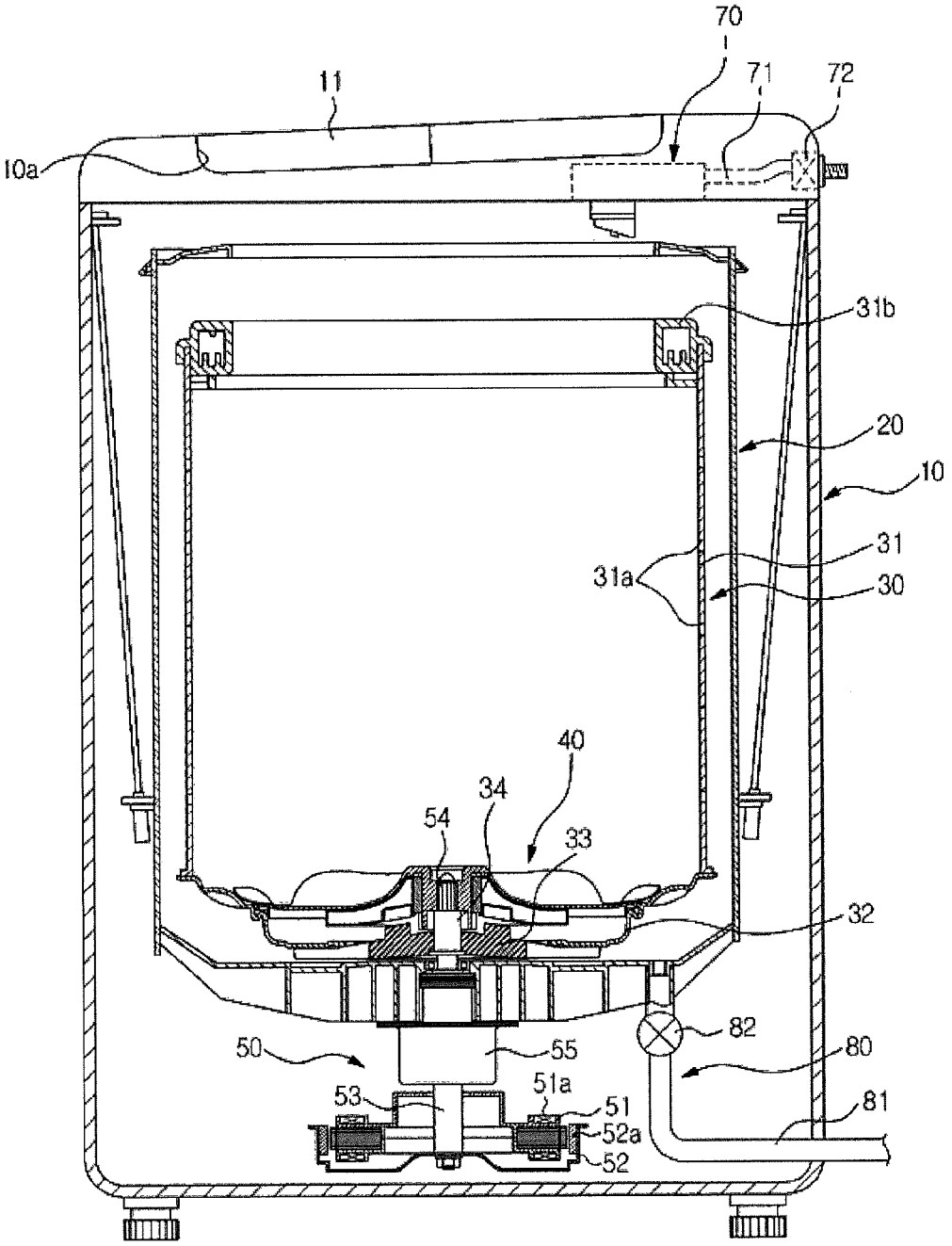
FIG. 1 is a sectional view illustrating a washing machine according to one embodiment of the present disclosure.

Reference will now be made in detail to the embodiments of the present disclosure, examples of which are illustrated in the accompanying drawings, wherein like reference numerals refer to like elements throughout.

As exemplarily shown in FIG. 1, a washing machine according to one embodiment of the present disclosure includes a housing 10 defining an external appearance of the washing machine, a tub 20 disposed in the housing 10 to store water therein, a spin basket 30 rotatably mounted in the tub 20, a pulsator 40 mounted in the spin basket 30 to generate water current, and a driving device 50 to rotate the pulsator 40.

The housing 10 is formed with a laundry entrance hole 10*a* at an upper surface thereof, through which a user places laundry into the spin basket 30. A door 11 is provided at the upper surface of the housing 10 to open and close the laundry entrance hole 10*a*.

The tub 20 is supported in the housing 10 by a suspension device. A water supply device 70 to supply water to the tub 20 is disposed above the tub 20. A drain device 80 to discharge wash water contained in the tub 20 to the outside is disposed below the tub 20.

The water supply device 70 includes a water supply pipe 71 connected to an external water supply source (not shown) and a water supply valve 72 mounted on the water supply pipe 71 to control the supply of water. The drain device 80 includes a drain pipe 81 connected to a lower portion of the tub 20 to discharge wash water contained in the tub 20 to the outside and a drain valve 82 mounted on the drain pipe 81 to control the drainage.

Figure 2:
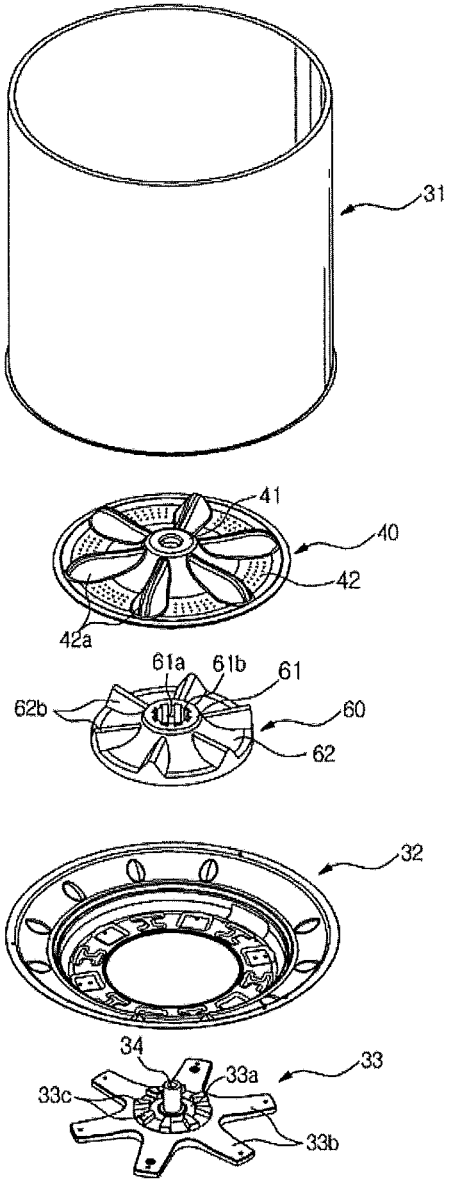
FIG. 2 is an exploded perspective view illustrating a mounting state of a buoyancy clutch in the washing machine according to one embodiment of the present disclosure.

As exemplarily shown in FIG. 2, the spin basket 30 includes a body part 31 formed in a cylindrical shape having an opened top portion and a base part 32 fixed to a lower end of the body part 31 to function as a bottom of the spin basket 30. The body part 31 of the spin basket 30 is formed with through-holes 31*a*, through which water circulates between the tub 20 and the spin basket 30. In addition, the spin basket 30 is provided with a balancer 31*b* at an upper portion thereof to counterbalance an unbalanced load of the spin basket 30, thereby ensuring stable rotation of the spin basket 30.

The spin basket 30 is configured to rotate by receiving driving force from the pulsator 40 through a buoyancy clutch 60 (which will be described later). For this rotation mechanism, the spin basket 30 includes a driving flange 33 which is mounted to the base part 32 functioning as the bottom of the spin basket 30 to receive driving force from the pulsator 40.

The driving flange 33 includes a flange hub part 33*a* formed at a center portion thereof and plural flange parts 33*b* extending outward in a radial direction from the flange hub part 33*a* and fixed to the base part 32 of the spin basket 30. A hollow dehydration shaft 34 is mounted to a center of the flange hub part 33*a* and defines a rotation center. A wash shaft 54 (which will be described later) is rotatably mounted in the dehydration shaft 34.

The pulsator 40 rotates in a forward and reverse direction in the spin basket 30 and generates water current. Laundry in the spin basket 30 is agitated by the water current generated by the pulsator 40 and washed by friction.

The pulsator 40 includes a pulsator hub part 41 formed at a center portion thereof to receive rotational force through the wash shaft 54 and an agitating part 42 formed at a periphery of the pulsator hub part 41 to generate water current.

The pulsator hub part 41 is formed in a cylindrical shape and defines a center of the pulsator 40. A top portion of the wash shaft 54 is coupled to the pulsator hub part 41 and thus rotational force from the wash shaft 54 is transmitted to the pulsator hub part 41. In this embodiment, the pulsator hub part 41 protrudingly extends downward from the center of the pulsator 40.

Figure 3:
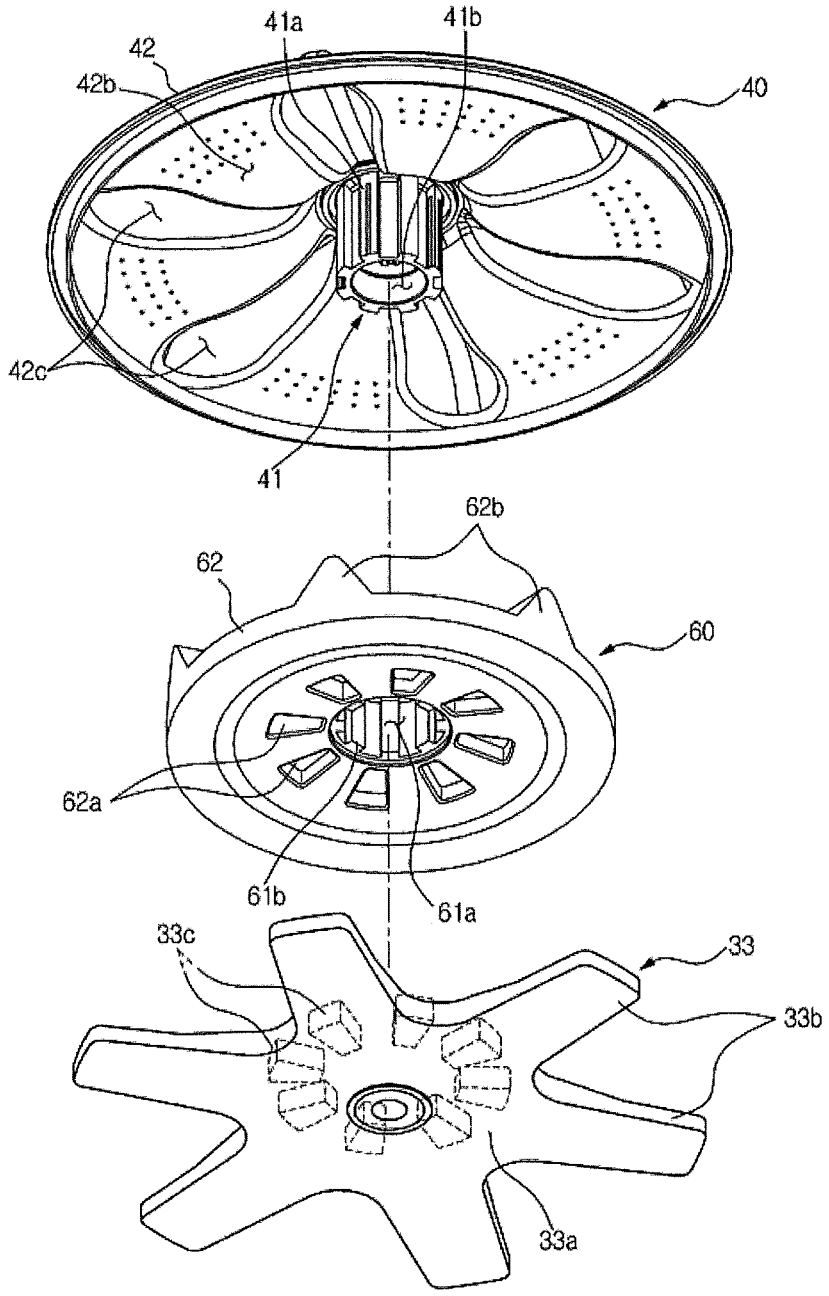
FIG. 3 is an exploded perspective view illustrating a mounting state of the buoyancy clutch to a pulsator in the washing machine according to one embodiment of the present disclosure.
Figure 4:
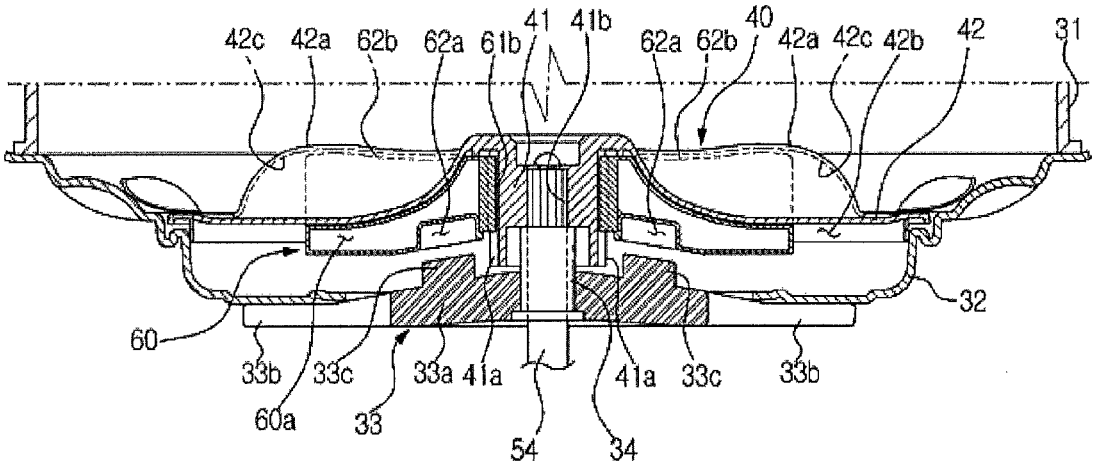
FIGS. 4 and 5 are sectional views illustrating operation of the buoyancy clutch of the washing machine according to one embodiment of the present disclosure.

As exemplarily shown in FIGS. 3 and 4, guide rails 41*a* are provided at an outer circumferential surface of the pulsator hub part 41. The guide rails 41*a* extend longitudinally in a vertical direction. Guide protrusions 61*b* of the buoyancy clutch 60 (which will be described later) are upwardly and downwardly movably engaged with the guide rails 41*a*. A shaft mounting hole 41*b* is formed in the pulsator hub part 41, in which the top portion of the wash shaft 54 is mounted. The shaft mounting hole 41*b* is formed with serrations at an inner circumferential surface thereof, and the wash shaft 54 is also formed with serrations, corresponding to the serrations of the shaft mounting hole 41*b*, at an outer circumferential surface of the top portion thereof. Through this engagement structure, the pulsator 40 receives rotational force through the wash shaft 54.

The agitating part 42 of the pulsator 40 includes plural washing ribs 42*a* to generate water current. The washing ribs 42*a* extend from the pulsator hub part 41 in a radial direction and are arranged spaced apart from each other in a circumferential direction. The agitating part 42 is formed with a receiving part 42*b* which is opened downward, in which the buoyancy clutch 60 is lifted and received. The pulsator hub part 41 protruding downward from the center of the pulsator 40 is positioned in the receiving part 42*b*.

Referring back to FIG. 1, the driving device 50 is disposed below the tub 20 and generates rotational force by electric power applied thereto. The driving device 50 includes a stator 51 having a coil 51*a*, a rotor 52 having a magnet 52*a* and configured to rotate by interaction between the magnet 52*a* and the coil 51*a* of the stator 51, a driving shaft 53, a lower end of which is connected to a center of the rotor 52, a wash shaft 54, an upper end of which is connected to the pulsator hub part 41 to transmit rotational force to the pulsator 40, and a reduction unit 55 disposed between the driving shaft 53 and the wash shaft 54 and containing a planetary gear system functioning as a speed reduction mechanism. The wash shaft 54 is mounted to the pulsator hub part 41 while penetrating the dehydration shaft 34. Accordingly, the pulsator 40 may rotate independently of the spin basket 30.

Referring back to FIGS. 2 through 4, the washing machine includes a buoyancy clutch 60 which selectively transmits rotational force generated from the driving device 50 to the spin basket 30 only in the dehydration process. By virtue of the selective transmission mechanism of the buoyancy clutch 60, the spin basket 30 may rotate in the dehydration process.

The buoyancy clutch 60 includes cavities 60*a* formed therewithin, which are filled with gas such as air or the like. The buoyancy clutch 60 obtains buoyancy through the gas filling the cavities 60*a*. When water is poured into the tub 20 above a designated water level in the washing process, the buoyancy clutch 60 is lifted by buoyancy. When water in the tub 20 is discharged below a designated water level in the dehydration process, the buoyancy clutch 60 moves back downward by its own weight.

The buoyancy clutch 60 is upwardly and downwardly movably mounted to the pulsator hub part 41 to rotate together with the pulsator 40. The buoyancy clutch 60 selectively transmits rotational force to the spin basket 30 by moving up or down by buoyancy.

The buoyancy clutch 60 includes a clutch hub part 61 movably mounted to the pulsator hub part 41 and a clutch part 62 extending from the clutch hub part 61 in a radial direction and configured to transmit force to the spin basket 30 when the buoyancy clutch 60 moves down.

The clutch hub part 61 is formed with a guide hole 61*a* through which the buoyancy clutch 60 is upwardly and downwardly movably mounted to the pulsator hub part 41. The guide hole 61*a* is provided with guide protrusions 61*b* at an inner circumferential surface thereof. The guide protrusions 61*b* of the guide hole 61*a* are upwardly and downwardly movably engaged with the guide rails 41*a* of the pulsator hub part 41. The guide protrusions 61*b* are configured such that a portion of each of the guide protrusions 61*b* is kept in engagement with each of the guide rails 41*a* even when the buoyancy clutch 60 moves downward. The engagement between the guide protrusions 61*b* of the buoyancy clutch 60 and the guide rails 41*a* of the pulsator hub part 41 enables the buoyancy clutch 60 to move up and down with respect to the pulsator hub part 41 and also to rotate together with the pulsator 40 by receiving rotational force from the pulsator 40.

The clutch part 62 is formed with concave-shaped coupling recesses 62*a* at a bottom surface thereof. Coupling protrusions 33*c* (which will be described later) are fitted into the coupling recesses 62*a* when the buoyancy clutch 60 moves downward.

The receiving part 42*b* of the pulsator 40 is formed with recesses 42*c*, each of which is defined by a bottom surface of each of the washing ribs 42*a*. The buoyancy clutch 60 is provided with protruding parts 62*b* protruding upward from an upper surface of the clutch part 62 and configured to be respectively inserted into the recesses 42*c*. The protruding parts 62*b* are arranged at positions corresponding to the washing ribs 42*a* and are respectively inserted into the recesses 42*c* defined by the bottom surfaces of the washing ribs 42*a* when the buoyancy clutch 60 moves upward. The buoyancy exerted on the buoyancy clutch 60 is proportional to a volume of the buoyancy clutch 60, however, an internal space of the receiving part 42*b* of the pulsator 40 is limited. Under this circumstance, a volume of the buoyancy clutch 60 may be maximized through the protruding parts 62*b* provided corresponding to the recesses 42*c* defined by the bottom surfaces of the washing ribs 42*a*.

In this embodiment, the guide rails 41*a* are provided in plural and are spaced apart from each other on an outer circumferential surface of the pulsator hub part 41 in a circumferential direction. The guide protrusions 61*b* are provided in plural and are spaced apart from each other on an inner circumferential surface of the guide hole 61*a* in a circumferential direction. Accordingly, the plural guide rails 41*a* and the plural guide protrusions 61*b* ensure stable vertical movement of the buoyancy clutch 60 and rotational force transmission from the pulsator 40 to the buoyancy clutch 60.

The spin basket 30 is configured to rotate by selectively receiving rotational force according to the position of the buoyancy clutch 60.

The spin basket 30 includes coupling protrusions 33*c* which are fitted into the coupling recesses 62*a* of the buoyancy clutch 60 when the buoyancy clutch 60 moves downward. That is, when the buoyancy clutch 60 moves downward, the coupling protrusions 33*c* are fitted into the coupling recesses 62*a*. When the buoyancy clutch 60 moves upward, the coupling protrusions 33*c* are separated from the coupling recesses 62*a*.

The coupling protrusions 33*c* are formed integrally with the flange hub part 33*a* of the driving flange 33, and are provided in plural and are spaced apart from each other in a circumferential direction. The coupling recesses 62*a* formed at a bottom surface of the clutch part 62 of the buoyancy clutch 60 are also provided in plural and are spaced apart from each other in a circumferential direction, correspondingly to the plural coupling protrusions 33*c*.

The coupling protrusions 33*c* are formed integrally with the driving flange 33 through an injection molding method or the like, by which the driving flange 33 stably receives rotational force from the buoyancy clutch 60 without using any additional components.

Hereinafter, operation of the buoyancy clutch of the washing machine according to one embodiment of the present disclosure will be described with reference to the drawings.

Figure 6:
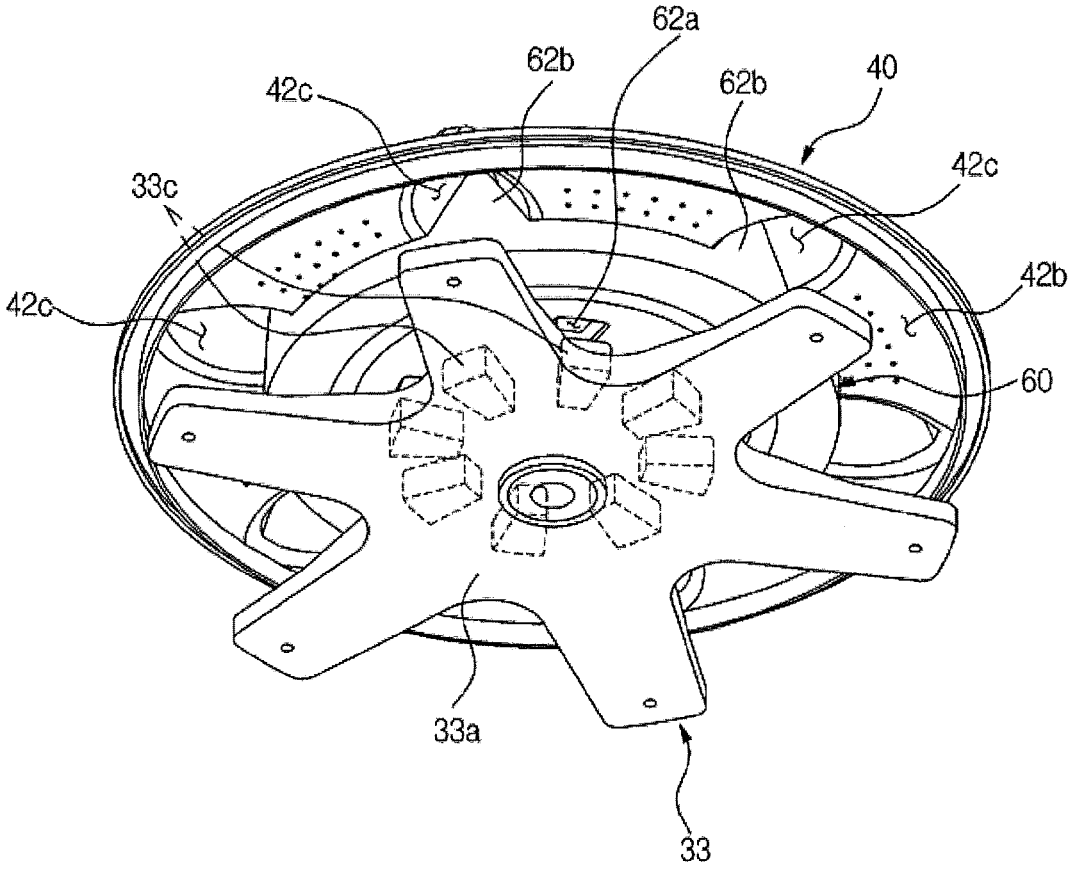
FIGS. 6 and 7 are perspective views illustrating operation of the buoyancy clutch of the washing machine according to one embodiment of the present disclosure.

When water is poured into the tub 20 above a designated water level, e.g., in the washing process, as exemplarily shown in FIGS. 4 and 6, the buoyancy clutch 60 moves upward by buoyancy. As the buoyancy clutch 60 moves upward, the coupling protrusions 33*c* are separated from the coupling recesses 62*a* of the buoyancy clutch 60, and thus the buoyancy clutch 60 and the spin basket 30 are disengaged.

In this disengagement state between the buoyancy clutch 60 and the spin basket 30, when the driving device 50 generates rotational force by electric power applied thereto, the rotational force is transmitted to the pulsator 40 through the driving shaft 53 and the wash shaft 54 and the pulsator 40 rotates. The buoyancy clutch 60 also rotates together with the pulsator 40 by receiving the rotational force from the pulsator 40 through the guide protrusions 61*b*.

However, since the buoyancy clutch 60 is not engaged with the spin basket 30, the rotational force is not transmitted to the spin basket 30 although the buoyancy clutch 60 rotates. Accordingly, the pulsator 40 rotates in the spin basket 30 which is kept in a stationary state, thereby generating water current and performing the washing process.

Figure 5:
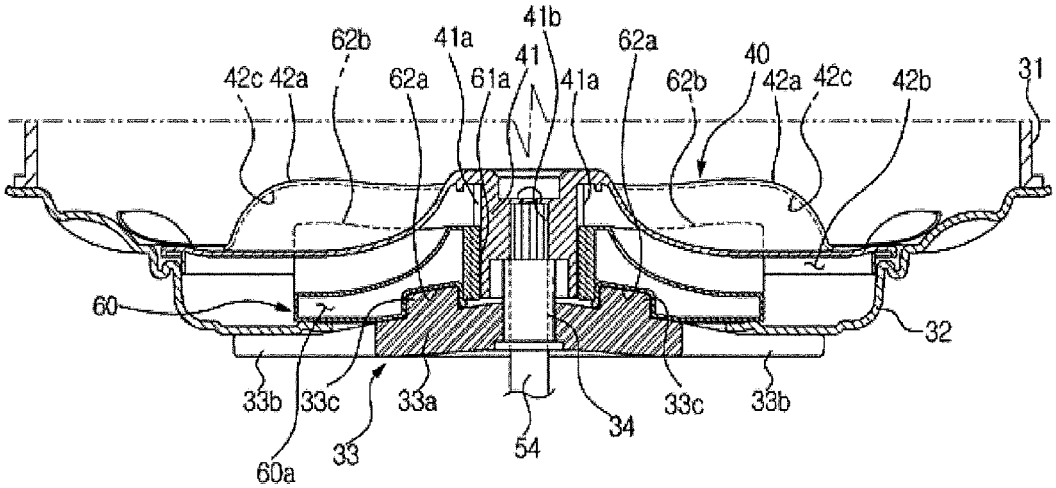
Figure 7:
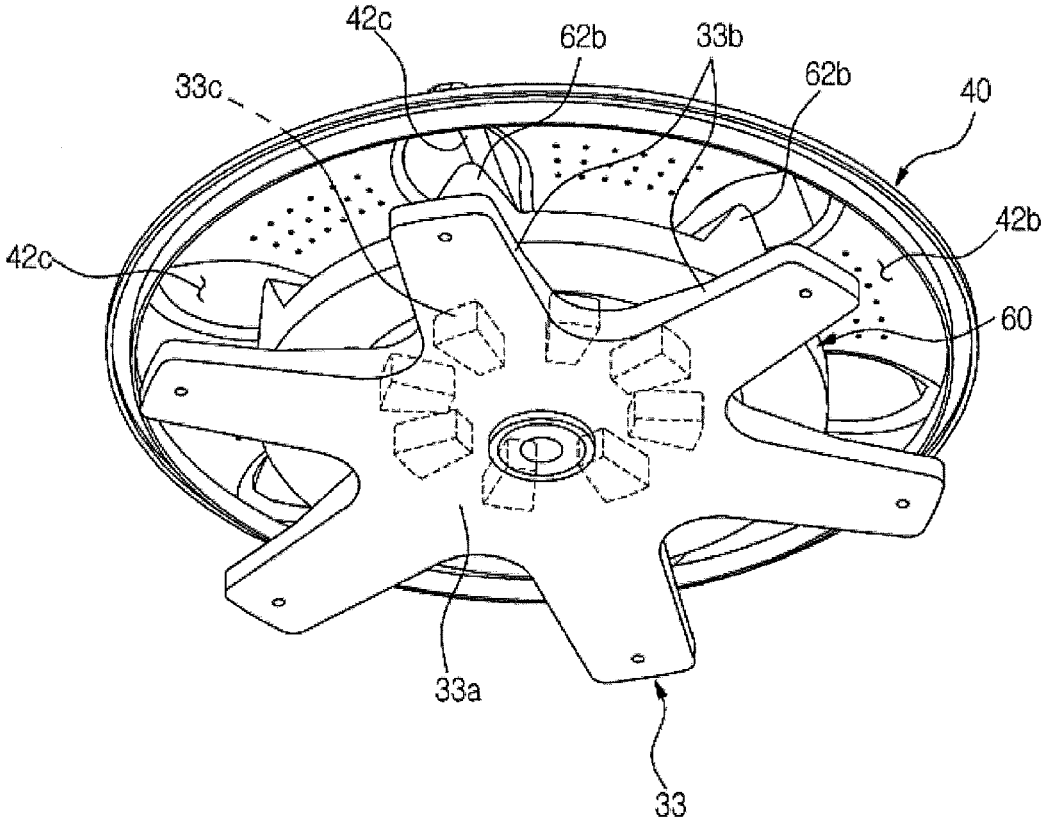

Next, when the water in the tub 20 is discharged below a designated water level, e.g., in the dehydration process, buoyancy is not exerted on the buoyancy clutch 60, and thus the buoyancy clutch 60 moves downward by its own weight as exemplarily shown in FIGS. 5 and 7. As the buoyancy clutch 60 moves downward, the coupling protrusions 33*c* provided at the spin basket 30 are fitted into the coupling recesses 62*a* of the buoyancy clutch 60, and thus the buoyancy clutch 60 is engaged with the spin basket 30.

In this engagement state between the buoyancy clutch 60 and the spin basket 30, when the driving device 50 generates rotational force by electric power applied thereto, the rotational force is transmitted to the pulsator 40 through the driving shaft 53 and the wash shaft 54 and the pulsator 40 rotates. The buoyancy clutch 60 also rotates by receiving the rotational force from the pulsator 40 through the guide protrusions 61*b*. According to rotation of the buoyancy clutch 60, the spin basket 30 engaged with the buoyancy clutch 60 receives the rotational force through the coupling protrusions 33*c* and rotates together with the pulsator 40, thereby performing the dehydration process.

Hereinafter, a washing machine according to another embodiment of the present disclosure will be described with reference to the drawings.

Figure 8:
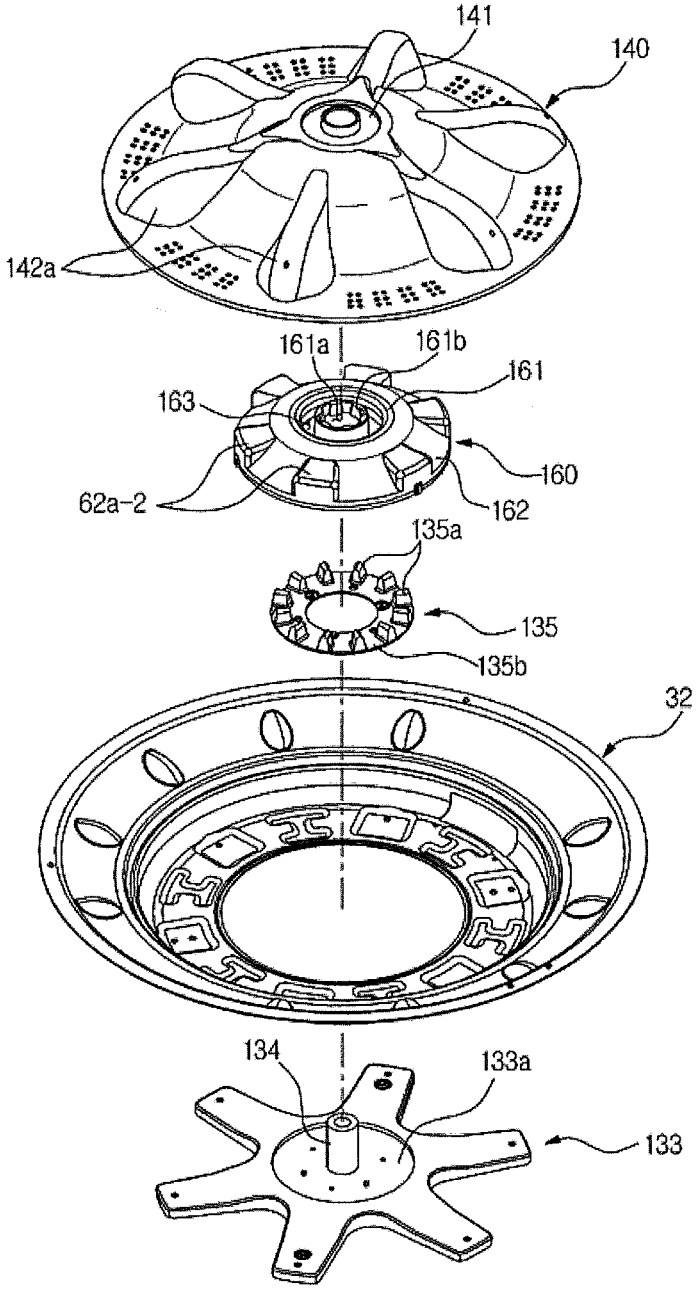
FIG. 8 is an exploded perspective view illustrating a mounting state of a buoyancy clutch of a washing machine according to another embodiment of the present disclosure.

As exemplarily shown in FIG. 8, a washing machine according to another embodiment of the present disclosure includes a driving flange 133 mounted to the base part 32 of the spin basket 30, a pulsator 140 having a pulsator hub part 141 extending downward from a center portion thereof, and a buoyancy clutch 160 having a clutch hub part 161 provided at a center portion thereof. The buoyancy clutch 160 is upwardly and downwardly movably mounted to the pulsator hub part 141 through a guide hole 161*a* formed at the clutch hub part 161.

In order to guide vertical movement of the buoyancy clutch 160, the pulsator hub part 141 is provided with plural guide rails 141*a* at an outer circumferential surface thereof, and the guide hole 161*a* is provided with plural guide protrusions 161*b* at an inner circumferential surface thereof. The guide protrusions 161*b* are upwardly and downwardly movably engaged with the guide rails 141*a*.

In order to enable the buoyancy clutch 160 to be coupled to the driving flange 133 when the buoyancy clutch 160 moves downward, concave-shaped coupling recesses 162*a* are formed at a bottom surface of a clutch part 162 of the buoyancy clutch 160, and coupling protrusions 135*a* are provided at the driving flange 133.

Figure 9:
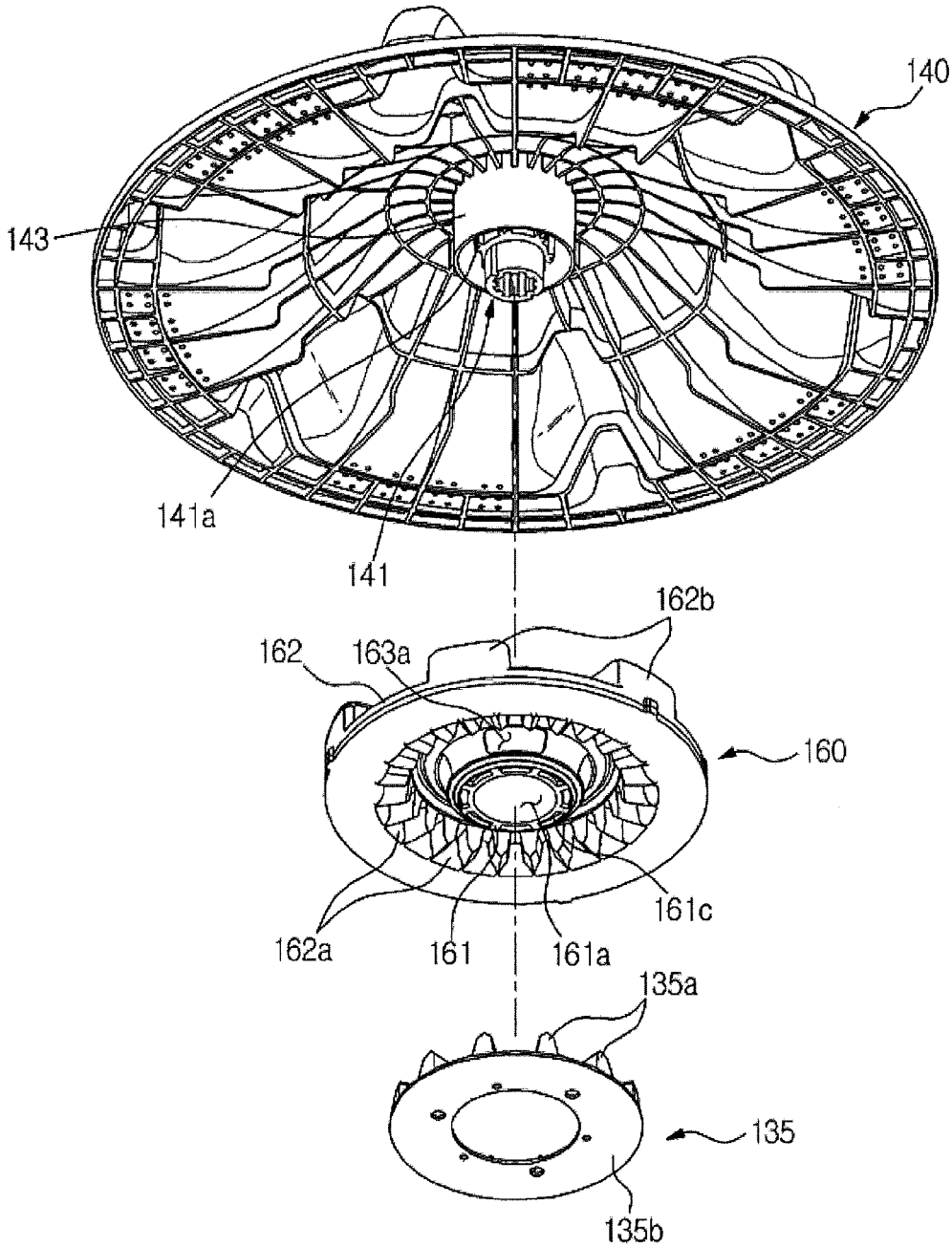
FIG. 9 is an exploded perspective view illustrating a mounting state of the buoyancy clutch to a pulsator in the washing machine according to another embodiment of the present disclosure.
Figure 14:
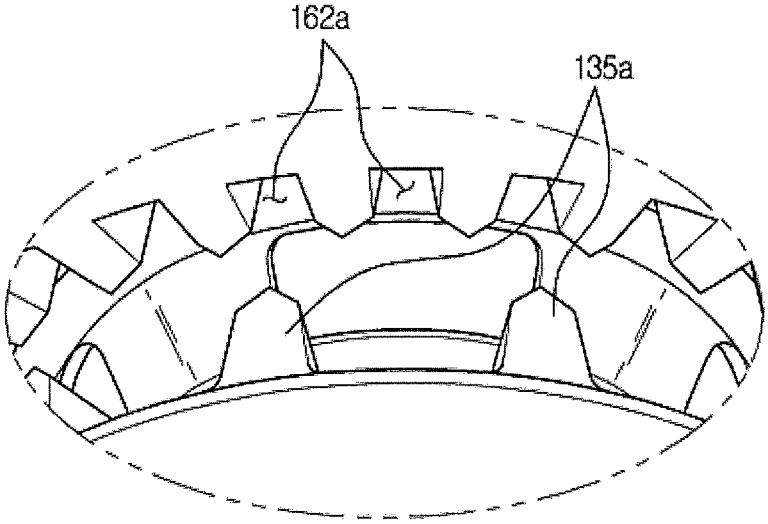
FIG. 14 is an enlarged view of an A portion in FIG. 13.

As exemplarily shown in FIG. 9, the coupling recesses 162*a* formed at a bottom surface of the buoyancy clutch 160 are provided in plural and are spaced apart from each other in a circumferential direction. The coupling protrusions 135*a* are provided in plural and are spaced apart from each other in a circumferential direction at a flange hub part 133*a* of the driving flange 133. Each of the coupling protrusions 135*a*, as exemplarily shown in FIG. 14, is formed to have a gradually decreasing width toward a top end thereof, so as to be easily inserted into the coupling recesses 162*a*.

In this embodiment, the coupling protrusions 135*a* are provided at a coupling unit 135. The coupling unit 135 includes a ring-shaped base plate 135*b*. The plural coupling protrusions 135*a* protrude upward from the base plate 135*b* and are spaced apart from each other in a circumferential direction. The coupling unit 135 is manufactured separately from the driving flange 133 and is fixed to the flange hub part 133*a* of the driving flange 133.

Figure 11:
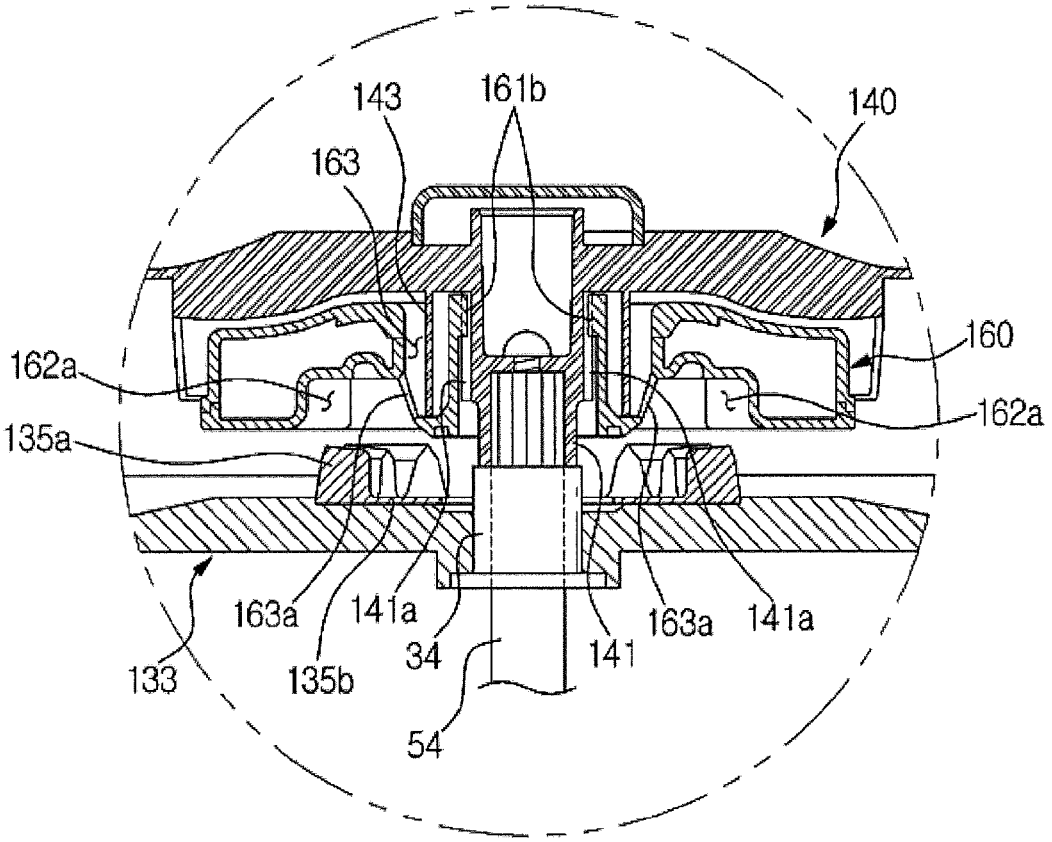
Figure 13:
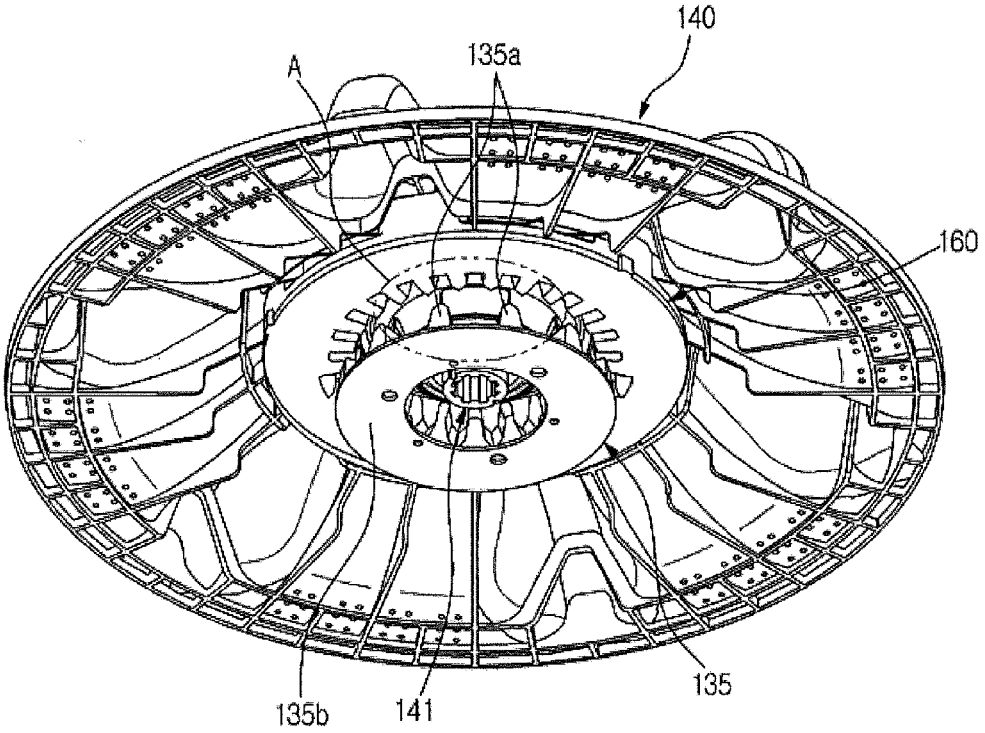

When water is poured into the tub 20 above a designated water level, as exemplarily shown in FIGS. 11 and 13, the buoyancy clutch 160 moves upward along the guide rails 141*a* by buoyancy. The coupling protrusions 135*a* of the spin basket 30 are separated from the coupling recesses 162*a* of the buoyancy clutch 160. In this state, although the pulsator 140 rotates, rotational force is not transmitted to the driving flange 133 of the spin basket 30 from the pulsator 140 and accordingly the spin basket 30 does not rotate.

Figure 10:
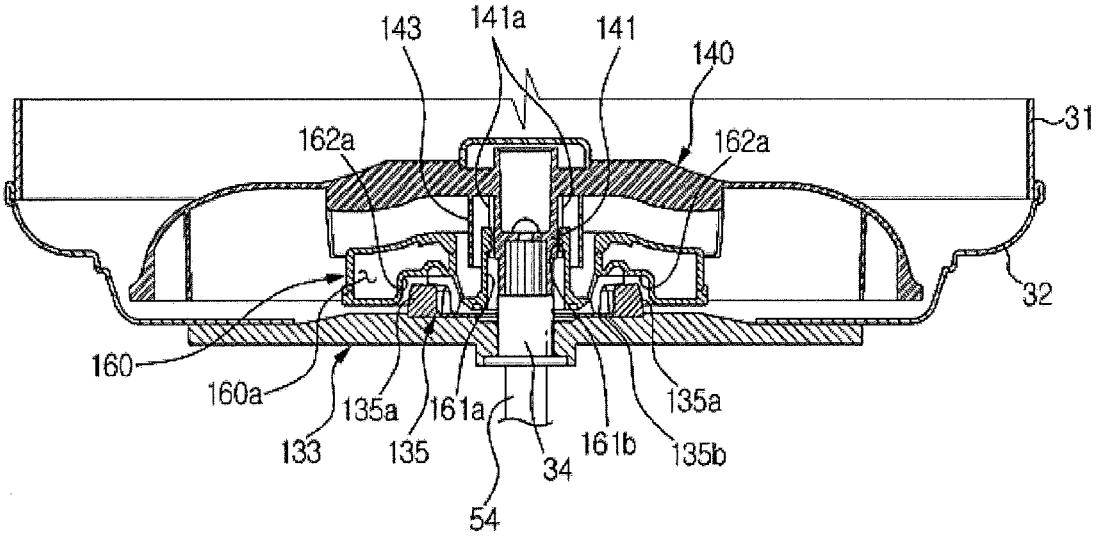
FIGS. 10 and 11 are sectional views illustrating operation of the buoyancy clutch of the washing machine according to another embodiment of the present disclosure.

When the water in the tub 20 is discharged below a designated water level, as exemplarily shown in FIGS. 10 and 12, the buoyancy clutch 160 moves downward along the guide rails 141*a*. The coupling protrusions 135*a* of the spin basket 30 are fitted into the coupling recesses 162*a* of the buoyancy clutch 160. In this state, if the pulsator 140 rotates, rotational force is transmitted to the driving flange 133 of the spin basket 30 from the pulsator 140 and accordingly the spin basket 30 rotates together with the pulsator 140.

As exemplarily shown in FIG. 14, the coupling recesses 162*a* are twice in number as the coupling protrusions 135*a*. That is, each of the coupling protrusions 135*a* is fitted into one of two adjacent coupling recesses 162*a*. This structure enables the coupling protrusions 135*a* to be smoothly fitted into the coupling recesses 162*a* and also decreases contact areas between the coupling protrusions 135*a* and the coupling recesses 162*a* by reducing the number of coupling protrusions 135*a* which are fitted into the coupling recesses 162*a*. Further, a phenomenon that particles such as fiber or lint are caught between the coupling protrusions 135*a* and the coupling recesses 162*a* is decreased.

The pulsator 140 further includes a barrier 143 which extends downward from a region near the pulsator hub part 141 to surround the periphery of the pulsator hub part 141. That is, the barrier 143 is formed in a hollow cylindrical shape and the pulsator hub part 141 is located inside the barrier 143.

The barrier 143 extends to an extent that a lower end of the barrier 143 is located at a lower position than a lower end of each of the guide rails 141*a*. By virtue of this structure, although water is partly introduced into the barrier 143 by a water pressure when the tub 20 is filled with water, the guide rails 141*a* are prevented from contacting the water.

The buoyancy clutch 160 is formed with a barrier accommodating recess 163 which is opened upward correspondingly to the barrier 143. The barrier accommodating recess 163 is formed at a region near the clutch hub part 161 and has a ring shape corresponding to the barrier 143.

Figure 12:
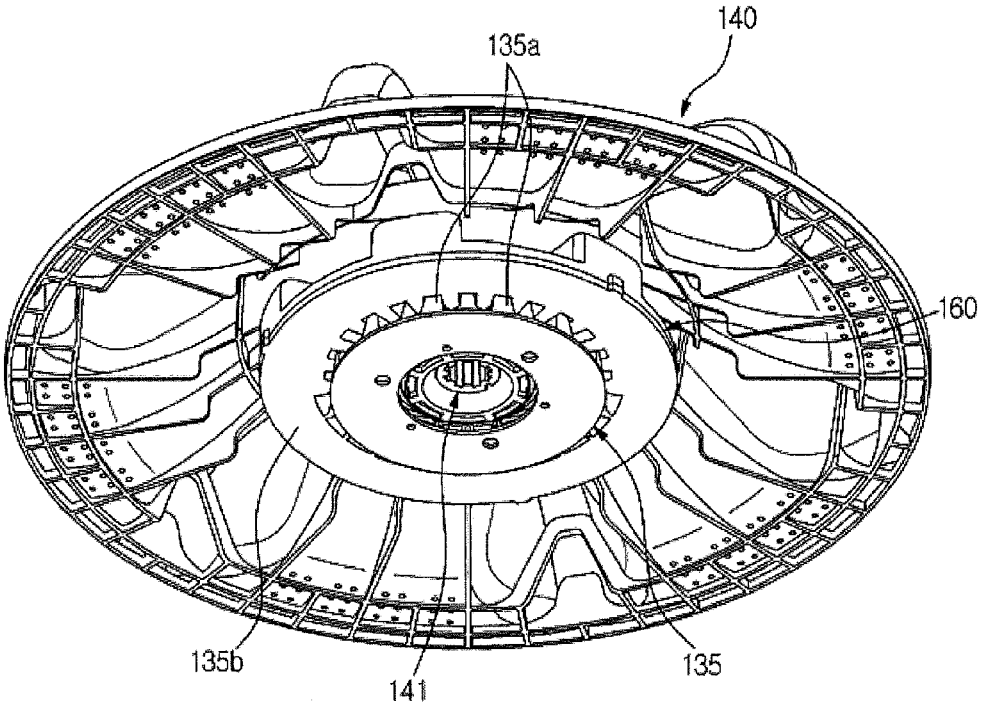
FIGS. 12 and 13 are perspective views illustrating operation of the buoyancy clutch of the washing machine according to another embodiment of the present disclosure.

Since the periphery of the pulsator hub part 141 is surrounded by the barrier 143, although the buoyancy clutch 160 moves upward by water filled in the tub 20 as exemplarily shown in FIGS. 11 and 12, water does not enter the barrier 143 due to air existing inside the barrier 143. Accordingly, the guide rails 141*a* positioned inside the barrier 143 are prevented from contacting the water. Even though the guide rails

141*a* come into contact with water, only an extremely small portion of the lower end of each of the guide rails 141*a* contacts the water.

If water enters the barrier 143 and a large part of the guide rails 141*a* contact the water, particles such as fiber or lint contained in the water are caught between the guide rails 141*a* and the guide protrusions 161*b* and disturb vertical movement of the buoyancy clutch 160. By virtue of the barrier 143 preventing the guide rails 141*a* from contacting the water, a phenomenon that particles such as fiber or lint are caught between the guide rails 141*a* and the guide protrusions 161*b* is remarkably decreased.

Since the buoyancy clutch 160 rotates together with the pulsator 140 as described above, water moves toward the center portion of the buoyancy clutch 160 and moves outward in a radial direction of the buoyancy clutch 160. If the water moving toward the center portion of the buoyancy clutch 160 continuously enters the barrier accommodating recess 163, the water may be introduced into the barrier 143 and may contact the guide rails 141*a*.

In order to prevent this undesirable phenomenon, the buoyancy clutch 160 is formed with communication holes 163*a* to communicate the barrier accommodating recess 163 with a region below the buoyancy clutch 160. Accordingly, even though water enters the barrier accommodating recess 163, the water moves to the region below the buoyancy clutch 160 through the communication holes 163*a*, thereby reducing the amount of water to be introduced into the barrier 143.

In addition, the clutch hub part 161 of the buoyancy clutch 160 is formed with reinforcing recesses 161*c* at a lower end thereof, each of which extends in a circumferential direction. The strength of the clutch hub part 161 may be reinforced through the reinforcing recesses 161*c*. The reinforcing recesses 161*c* are provided in plural and are spaced apart from each other in a circumferential direction.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A washing machine comprising:

a tub;

a spin basket rotatably mounted in the tub;

a pulsator rotatably mounted in the spin basket and having a pulsator hub part extending downward from a center portion of the pulsator;

a driving device to generate rotational force;

a wash shaft to transmit the rotational force generated from the driving device to the pulsator; and a buoyancy clutch upwardly and downwardly movably mounted to the pulsator hub part and configured to move up and down by buoyancy, wherein the buoyancy clutch is configured to rotate together with the pulsator, and when the buoyancy clutch moves down, the spin basket is engaged with the buoyancy clutch and receives the rotational force, the pulsator includes at least one guide rail formed longitudinally in a vertical direction at an outer surface of the pulsator hub part, and a receiving part which is opened downward to receive the buoyancy clutch therein, the buoyancy clutch includes a guide hole in which the pulsator hub part is inserted and at least one guide protrusion protruding from an inner surface of the guide hole and upwardly and downwardly movably engaged with the at least one guide rail , and plural protruding parts provided at positions corresponding to plural recesses of the receiving part, the pulsator hub part protrudes inside the receiving part, and the receiving part includes the plural recesses, each of which is defined by a bottom surface of each washing ribs of the pulsator.

2. The washing machine according to claim 1, wherein the at least one guide rail includes plural guide rails which are spaced apart from each other in a circumferential direction at an outer circumferential surface of the pulsator hub part, and the at least one guide protrusion includes plural guide protrusions which are spaced apart from each other in a circumferential direction at an inner circumferential surface of the guide hole, and wherein each of the plural guide protrusions is upwardly and downwardly movably engaged with each of the plural guide rails.

3. The washing machine according to claim 1, wherein the buoyancy clutch includes at least one coupling recess formed at a bottom surface thereof, and the spin basket includes at least one coupling protrusion which is configured to be fitted into the at least one coupling recess when the buoyancy clutch moves down.

4. The washing machine according to claim 3, wherein the spin basket includes a driving flange mounted to a bottom thereof, and the at least one coupling protrusion is formed integrally with the driving flange.

5. The washing machine according to claim 3, wherein the spin basket includes a driving flange mounted to a bottom thereof and a coupling unit provided with the at least one coupling protrusion and fixed to the driving flange.

6. The washing machine according to claim 3, wherein the at least one coupling recess includes plural coupling recesses which are spaced apart from each other in a circumferential direction at a bottom surface of the buoyancy clutch, and the at least one coupling protrusion includes plural coupling protrusions which are spaced apart from each other in a circumferential direction at the spin basket.

7. The washing machine according to claim 6, wherein the plural coupling recesses are twice in number as the plural coupling protrusions.

8. The washing machine according to claim 6, wherein each of the plural coupling protrusions is formed to have a gradually decreasing width toward a top end thereof.

9. The washing machine according to claim 1, wherein the pulsator includes a barrier extending downward from a region near the pulsator hub part to surround a periphery of the pulsator hub part.

10. The washing machine according to claim 9, wherein the barrier is formed in a hollow cylindrical shape.

11. The washing machine according to claim 10, wherein the buoyancy clutch includes a clutch hub part formed with the guide hole and a barrier accommodating recess formed at a region near the clutch hub part to accommodate the barrier.

12. The washing machine according to claim 11, wherein the buoyancy clutch includes a communication hole to communicate the barrier accommodating recess with a region below the buoyancy clutch.

13. The washing machine according to claim 9, wherein the barrier extends to an extent that a lower end thereof is located at a lower position than a lower end of the guide rail.

14. A washing machine comprising:

a tub;

a spin basket rotatably mounted in the tub;

a pulsator rotatably mounted in the spin basket;

a driving device to generate rotational force and transmit the rotational force to the pulsator; and a buoyancy clutch upwardly and downwardly movably mounted to the pulsator and configured to selectively transmit the rotational force to the spin basket by moving up or down by buoyancy, wherein the pulsator includes plural washing ribs to generate water current and plural recesses, each of which is defined by a bottom surface of each of the plural washing ribs, the buoyancy clutch includes plural protruding parts provided at positions corresponding to the plural washing ribs and configured to be inserted into the plural recesses when the buoyancy clutch moves upward and plural coupling recesses which are concavely formed at a bottom surface thereof and spaced apart from each other in a circumferential direction, and the spin basket includes plural coupling protrusions configured to be fitted into the plural coupling recesses when the buoyancy clutch moves downward.

15. The washing machine according to claim 14, wherein the pulsator includes a pulsator hub part extending downward from a center portion thereof, and the buoyancy clutch includes a guide hole formed at a center portion thereof, in which the pulsator hub part is inserted.

16. The washing machine according to claim 15, wherein the pulsator includes plural guide rails which extend longitudinally in a vertical direction and are spaced apart from each other in a circumferential direction at an outer surface of the pulsator hub part, and the buoyancy clutch includes plural guide protrusions which protrude from an inner surface of the guide hole and are upwardly and downwardly movably engaged with the plural guide rails.

17. The washing machine according to claim 16, wherein the pulsator includes a barrier extending downward from a region near the pulsator hub part to surround a periphery of the pulsator hub part.

18. The washing machine according to claim 17, wherein the barrier is formed in a hollow cylindrical shape.

19. The washing machine according to claim 18, wherein the buoyancy clutch includes a clutch hub part formed with the guide hole and a barrier accommodating recess formed at a region near the clutch hub part to accommodate the barrier.

20. The washing machine according to claim 19, wherein the buoyancy clutch includes a communication hole to communicate the barrier accommodating recess with a region below the buoyancy clutch.

21. The washing machine according to claim 17, wherein the barrier extends to an extent that a lower end thereof is located at a lower position than a lower end of the guide rail.

* * * * *